US010746165B2

(12) United States Patent
Schögler

(10) Patent No.: US 10,746,165 B2
(45) Date of Patent: Aug. 18, 2020

(54) SUCTION MUFFLER FOR A HERMETICALLY ENCAPSULATED REFRIGERANT COMPRESSOR

(71) Applicant: SECOP Austria GmbH, Fürstenfeld (AT)

(72) Inventor: Hans-Peter Schögler, Fehring (AT)

(73) Assignee: SECOP Austria GmbH, Fürstenfeld (AT)

( * ) Notice: Subject to any disclaimer, the term of this patent is extended or adjusted under 35 U.S.C. 154(b) by 555 days.

(21) Appl. No.: 15/520,277

(22) PCT Filed: Sep. 9, 2015

(86) PCT No.: PCT/AT2015/050222
§ 371 (c)(1),
(2) Date: Apr. 19, 2017

(87) PCT Pub. No.: WO2016/061597
PCT Pub. Date: Apr. 28, 2016

(65) Prior Publication Data

US 2017/0314543 A1 Nov. 2, 2017

(30) Foreign Application Priority Data

Oct. 22, 2014 (AT) ..... 50170/2014

(51) Int. Cl.
*F04B 39/00* (2006.01)
*F04B 39/12* (2006.01)
(Continued)

(52) U.S. Cl.
CPC ..... *F04B 39/0066* (2013.01); *F02M 35/1294* (2013.01); *F04B 39/0061* (2013.01); *F25B 31/023* (2013.01); *F25B 2500/12* (2013.01)

(58) Field of Classification Search
CPC .... F04B 39/00; F04B 39/0061; F04B 39/123; F04B 39/16; F04B 39/12; F25B 31/02; F25B 31/023; F25B 2500/12
See application file for complete search history.

(56) References Cited

U.S. PATENT DOCUMENTS 3,291,384 A * 12/1966 Garland ..... F04C 18/3442 418/152
4,793,775 A * 12/1988 Peruzzi ..... F04B 39/0055 417/312
(Continued)

FOREIGN PATENT DOCUMENTS

AT GM50170/2014 10/2014
CN 1148669 A 4/1997
(Continued)

OTHER PUBLICATIONS

SECOP Austria GmbH, PCT/AT2015/050222 "International Preliminary Examination Report and Written Opinion," dated Oct. 14, 2016.
(Continued)

*Primary Examiner* — Edgardo San Martin
(74) *Attorney, Agent, or Firm* — McKee, Voorhees & Sease, PLC

(57) ABSTRACT

Suction muffler (1) for a hermetic refrigeration compressor (2), the suction muffler (1) comprising an inlet (3), so that refrigerant can flow into the suction muffler (1), and an outlet (4), so that refrigerant can flow out from the suction muffler (1), the suction muffler (1) further comprising two damping chambers (5, 6) for sound damping, where the two damping chambers (5, 6) each has a floor (8, 9) and where a wall element (11) is provided, in order to separate the two damping chambers (5, 6) from each other for the refrigerant in the region of their floors (8, 9). In order to guarantee that the damping chambers (5, 6) are overall as gas-tight and
(Continued)

sound-tight as possible, it is provided according to the invention that in the region of the wall element (11) at least one siphon segment (16) that connects the two floors is disposed, in order to receive oil (14) in an operating position of the suction muffler (1), where the at least one siphon segment (16) connects the two damping chambers (5, 6) in siphon fashion to each other for the oil (14).

12 Claims, 6 Drawing Sheets

(51) Int. Cl.
*F02M 35/12* (2006.01)
*F25B 31/02* (2006.01)

(56) References Cited

U.S. PATENT DOCUMENTS

| | | | | |
|---|---|---|---|---|
| 6,845,843 | B2 * | 1/2005 | Svendsen | F04B 39/0061 181/212 |
| 7,316,291 | B2 * | 1/2008 | Thomsen | F04B 39/0061 181/229 |
| 8,246,320 | B2 * | 8/2012 | Park | F04B 39/0055 181/229 |
| 9,080,562 | B2 * | 7/2015 | Moreira | F04B 39/0061 |
| 2003/0150670 | A1 * | 8/2003 | Svendsen | F04B 39/0061 181/262 |
| 2006/0045762 | A1 * | 3/2006 | Lee | F04B 39/0061 417/312 |

FOREIGN PATENT DOCUMENTS

| | | | |
|---|---|---|---|
| CN | 1338030 | A | 2/2002 |
| CN | 100383386 | C | 4/2008 |
| CN | 201221882 | Y | 4/2009 |
| CN | 102971533 | A | 3/2013 |
| CN | 103628962 | A | 3/2014 |
| CN | 203488335 | U | 3/2014 |
| DE | 10323526 | B3 | 2/2005 |
| WO | 8602703 | A1 | 5/1986 |
| WO | 2016061597 | A2 | 4/2016 |

OTHER PUBLICATIONS

SECOP Austria GmbH, GM50170/2014, Search Report, dated Mar. 18, 2015.
SECOP Austria GmbH, "International Search Report," PCT/AT2015/050222, dated Apr. 6, 2016.
Espacenet Abstract of CN1148669, accessed on May 14, 2019.
Espacenet Abstract of CN1338030, accessed on May 14, 2019.
Espacenet Abstract of CN100383386, accessed on May 14, 2019.
Espacenet Abstract of CN102971533, accessed on May 14, 2019.
Espacenet Abstract of CN103628962, accessed on May 14, 2019.
Espacenet Abstract of CN201221882, accessed on May 14, 2019.
Espacenet Abstract of CN203488335, accessed on May 14, 2019.

* cited by examiner

SUCTION MUFFLER FOR A HERMETICALLY ENCAPSULATED REFRIGERANT COMPRESSOR

CROSS REFERENCE TO RELATED APPLICATIONS

This is a national phase of PCT/AT2015/050222, filed Sep. 9, 2015 and claims priority to Austrian Application No. GM 50170/2014, filed on Oct. 4, 2014, each of which are herein incorporated by reference in their entirety.

FIELD OF INVENTION

This invention concerns a suction muffler for a hermetic refrigeration compressor, the suction muffler comprising an inlet, so that refrigerant can flow into the suction muffler, and an outlet, so that refrigerant can flow out from the suction muffler, the suction muffler further comprising two damping chambers for sound damping, where the two damping chambers each has a floor, and where a wall element is provided in order to separate the two damping chambers from each other for the refrigerant in the region of their floors.

PRIOR ART

Hermetic refrigeration compressors have long been known and are used chiefly in refrigerators or refrigerated display cases. The refrigeration process as such likewise has long been known. Refrigerant is heated by absorption of energy from the space to be cooled in an evaporator and then superheated and pumped to a higher pressure by means of the piston/cylinder unit of the refrigeration compressor, where it gives up heat via a condenser and is transported back to the evaporator via a throttle, in which a reduction of pressure and the cooling of the refrigerant take place.

Suction of the (gaseous) refrigerant takes place during a suction stroke of the piston/cylinder unit through a suction tube coming directly from the evaporator. In the known hermetic refrigeration compressors the suction tube as a rule joins the hermetic compressor housing in the vicinity of an inlet of a suction muffler (also called "muffler"), from which the refrigerant flows into the suction muffler and through it to a suction valve of the piston/cylinder unit. The suction muffler serves first of all to keep the noise level of the refrigeration compressor as low as possible during the suction operation. Known suction mufflers as a rule consist of a plurality of spaces or damping chambers, which are connected to each other. These mufflers damp the sound based on the well-known Helmholtz principle, i.e., the damping chambers function as resonators that absorb sound. In addition, known suction mufflers have an inlet, through which the refrigerant is drawn into the interior of the suction muffler, and an outlet, which sits tightly sealed at the suction valve of the piston/cylinder unit.

Besides the refrigerant, it is essential for oil, which is necessary for lubrication of the piston/cylinder unit, to also pass into the suction muffler. The oil collects on the floor of the damping chambers. In order to get the oil back out of the suction muffler, or the damping chambers, there is usually at least one oil drain hole in each damping chamber, through which the oil can flow out into the compressor housing.

However, such oil drain holes are problematic in two ways. For one thing, a gas exchange with the compressor housing can take place through these oil drain holes. This means that hot gaseous refrigerant, which is situated in the compressor housing, can in this way get into the suction muffler and then further into the piston/cylinder unit, which will reduce the efficiency of the refrigeration compressor. For another thing, sound can escape through the oil drain holes, which adversely affects the sound damping that can be achieved with the suction muffler.

A suction muffler with damping chambers is known from WO 86/02703 A1, the damping chambers having separators for liquid portions of the suctioned fluid, which comprises the gaseous refrigerant, liquid portions of the refrigerant, and portions of oil. The separators are formed merely by suitably tilted floors of the damping chambers. So that liquid can collect in the separators due to the force of gravity, connecting passages are provided between the damping chambers. The fluid is suctioned through the labyrinth-like structure of the suction muffler, in particular also through the connecting passages, through which separation of the liquid portions of the fluid ultimately takes place. It is disadvantageous with this solution that sound can escape from the individual damping chambers through the connecting passages, which has an adverse effect on the sound or noise generation. Also, the liquid level in the separators in this case cannot be so high in practice that the connecting passages become blocked. On the one hand, such an amount of liquid is in fact not present. On the other hand, such a blockage of the connecting passages would have fatal effects on the noise or sound generation, since the suctioned fluid is still being drawn through the connecting passages and would give rise to a strong bubbling noise.

Furthermore, DE 10121526 B3 shows a generic suction having two chambers, which separated by a wall.

AIM OF THE INVENTION

Therefore, it is the aim of this invention to make available a suction muffler for a hermetic refrigeration compressor that avoids the disadvantages mentioned above. In particular, it should be ensured that the damping chambers of the suction muffler are as gas-tight and sound tight as possible with respect to the compressor housing.

NATURE OF THE INVENTION

The heart of this invention is to create a connection between the damping chambers that is only for oil, where said connection is leaktight in particular for the gaseous refrigerant. In this way it becomes possible for oil to be able to flow from one damping chamber to another damping chamber without an exchange of gaseous refrigerant being able to take place through said connection. This additionally ensures that sound cannot escape from the damping chambers from this connection. Thus, one need provide a means for draining the collected oil, for example an oil drain hole or a valve, through which the sound-tight and gas-tight properties of the damping chambers are overall maximized, in only one of the damping chambers.

Correspondingly, in case of a suction muffler for a hermetic refrigeration condenser, the suction muffler comprising an inlet, so that refrigerant can flow into the suction muffler, and an outlet, so that refrigerant can flow out from the suction muffler, the suction muffler further comprising two damping chambers for sound damping, where the two damping chambers each has a floor and where a wall element is provided in order to separate the two damping chambers for the refrigerant from each other in the region of their floors, it is provided according to the invention that at least one siphon segment connecting the two floors is disposed in the region of the wall element in order to receive oil in an operating position of the suction muffler, where the at least one siphon segment connects the two damping chambers for the oil to each other in siphon fashion.

The oil can collect on the relevant floor, which is preferably designed so that the oil flows in the direction of the siphon segment in the operating position of the suction muffler. In order to optimize the collection of the oil and in particular the delivery of the oil to the siphon segment, it is provided in a preferred embodiment of the suction muffler according to the invention that a channel is disposed in at least one of the two floors in order to receive oil in the operating position of the suction muffler, where the channel is connected to the at least one siphon segment. Preferably, the channel is designed so that the oil flows toward the siphon segment in the operating position of the suction muffler.

In order to enable simple manufacture of the channel and the siphon segment, it is provided in a preferred embodiment of the suction muffler according to the invention that the at least one siphon segment is made as a depression in the two floors and that preferably the channel is made as an additional depression in the at least one of the two floors, where the additional depression is not as deep as the [former] depression in at least a segment. Preferably, an arrangement that is essentially U- or V-shaped in cross section results from the siphon segment depression together with the wall element, so that the action of a siphon is achieved when the siphon segment becomes filled with oil sufficiently that the wall element dips into the oil or contacts the oil.

Of course, more than two damping chambers according to the invention can also be connected for oil. Correspondingly, it is provided in a preferred embodiment of the suction muffler according to the invention that at least one additional damping chamber is provided, that the at least one additional damping chamber has a floor, and that at least one additional wall element is provided, in order to separate the at least one additional damping chamber for the refrigerant from at least one of the other damping chambers in the region of the relevant floor, where in the region of the at least one additional wall element at least one additional siphon segment connecting the relevant floors is disposed, in order to receive oil in an operating position of the suction muffler, and where the at least one additional siphon segment connects the at least one additional damping chamber to at least one of the other damping chambers in siphon fashion for the oil.

The oil can in this case collect on the bottom of the at least one additional damping chamber, which is preferably designed so that the oil flows in the direction of the at least one additional siphon segment in the operating position of the suction muffler. To optimize the collection of the oil and in particular the delivery of the oil to at least one additional siphon segment, the channel can be extended to the at least one additional evaporation chamber. Thus, it is provided in a preferred embodiment of the suction muffler according to the invention that the channel is also disposed in the floor of the at least one additional damping chamber in order to receive oil in the operating position of the suction muffler, where the channel is connected to the at least one additional siphon segment. Preferably, the channel is designed so that the oil flows to at least one additional siphon segment in the operating position of the suction muffler.

In order to be able to let the oil ultimately flow out from the suction muffler, it is provided in a preferred embodiment of the suction muffler according to the invention that an oil drain hole is disposed in the floor of a damping chamber. In an especially preferred embodiment of the suction muffler according to the invention, it is provided that exactly one oil drain hole is provided, through which the sound-tight and gas-tight properties of the damping chambers are overall maximized in any case.

In order to be able to direct the oil specifically to the oil drain hole, it is provided in a preferred embodiment of the suction muffler according to the invention that the channel is connected to the oil drain hole. Preferably, the channel is designed so that the oil flows toward the oil drain hole in the operating position of the suction muffler.

It goes without saying that the floors of the first and second damping chambers can be made in one piece. Of course, the one-piece design can comprise the siphon segment. Furthermore, the one-piece design of the floor can also comprise the floor of the at least one additional damping chamber. Finally, the one-piece design can also comprise the at least one additional siphon segment. Thus, it is provided in a preferred embodiment of the suction muffler according to the invention that the floors and the at least one siphon segment and preferably the at least one additional siphon segment are made in one piece.

It goes without saying that the channel can also be contained in the one-piece design.

A refrigeration compressor with high efficiency can be achieved through the high gas-tightness with the help of the suction muffler according to the invention. At the same time, the noise level of such a refrigeration compressor decreases to an extremely low level because of the good sound tightness of the suction muffler according to the invention. Thus, according to the invention a hermetic refrigeration compressor is provided, which has a hermetically tight compressor housing, in the inside of which a piston/cylinder unit that compresses the refrigerant operates with a suction valve comprising a suction orifice disposed in a valve plate thereof, where a suction muffler according to the invention is disposed at a cylinder head of the piston/cylinder unit so that the refrigerant can flow through the suction muffler to the suction valve.

BRIEF DESCRIPTION OF THE FIGURES

The invention will now be explained in more detail by means of embodiment examples. The drawings are exemplary and are intended to represent the concept of the invention, but not in any way to limit it or even to reproduce it in a final form. Here.

WAYS TO IMPLEMENT THE INVENTION

Figure 1:
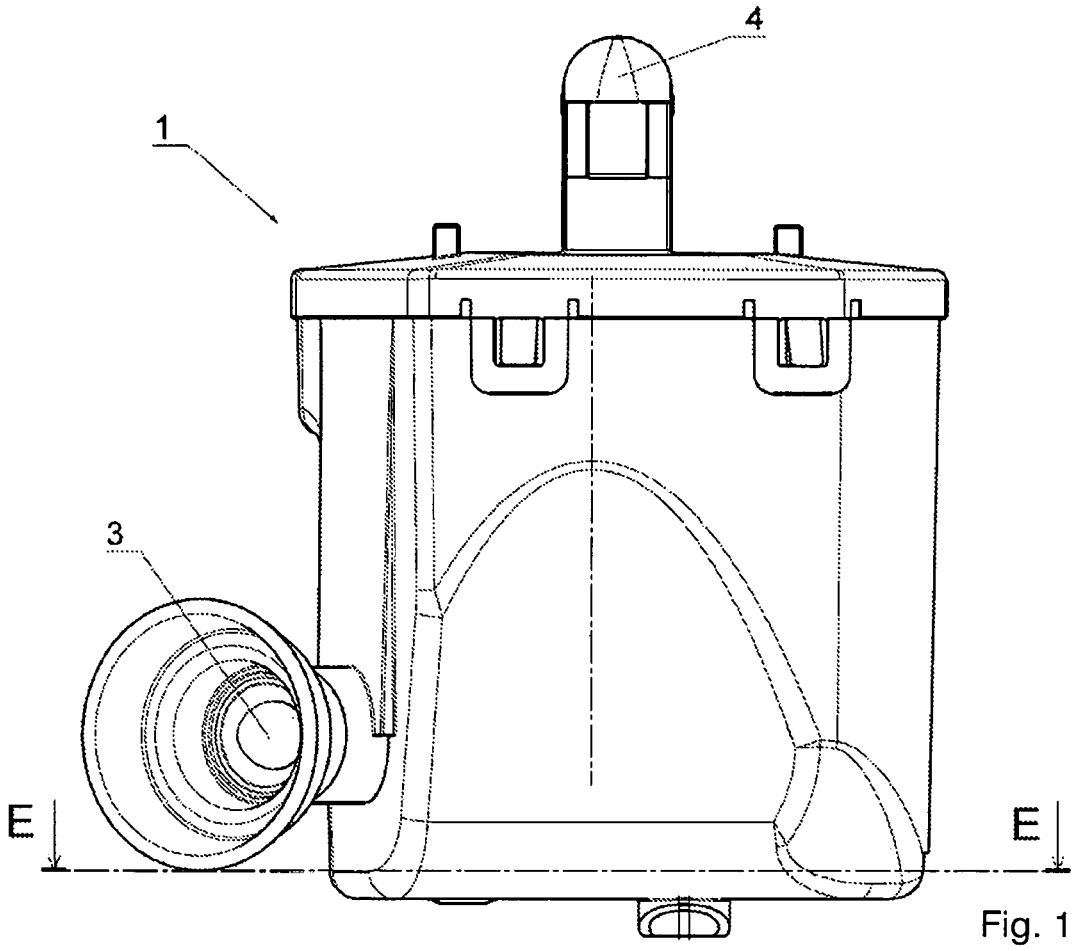
FIG. 1 shows a front view of a suction muffler according to the invention

FIG. 1 shows a suction muffler 1 according to the invention for a hermetic refrigeration compressor 2 (see FIG. 7) in a front view. The suction muffler 1 has an inlet 3, through which refrigerant, which is drawn into refrigeration compressor 2 in gaseous state, can flow into the suction muffler 1, and an outlet 4, through which the refrigerant can flow out from the suction muffler 1.

The suction muffler 1 is shown in FIG. 1 in an operating position so that here the vertical orientation of the suction muffler 1 is such that the section line E-E corresponds to a section through the lower region of the suction muffler 1 in operating position.

Figure 2:
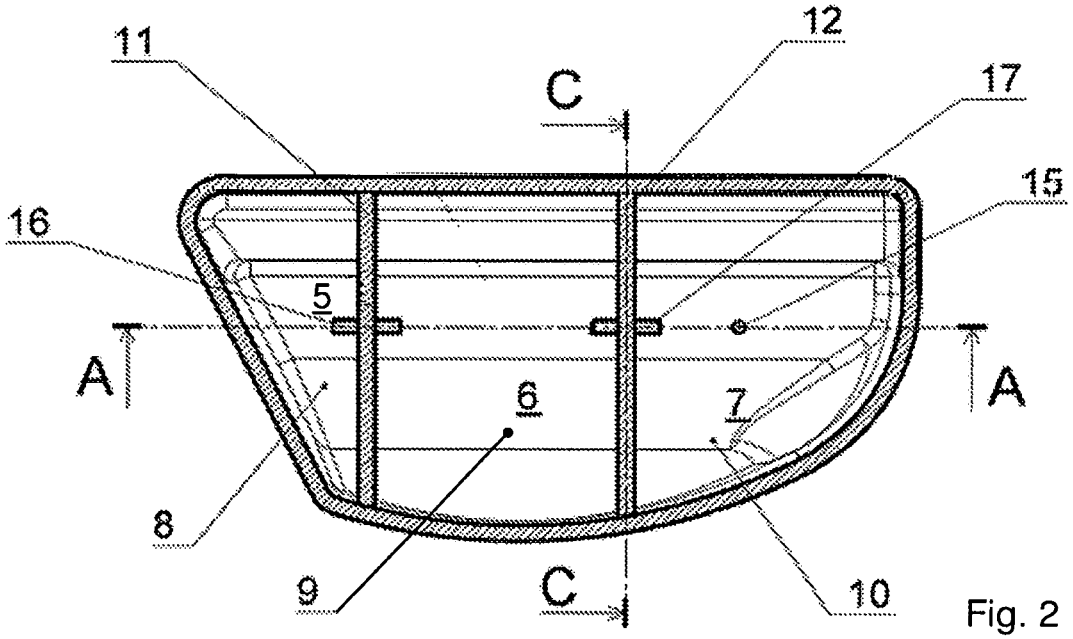
FIG. 2 shows a sectional view of the suction muffler in FIG. 1 through section line E-E shown in FIG. 1

FIG. 2 shows a sectional view through section line E-E in FIG. 1, where the arrow in FIG. 1 indicates the direction of view. One can see that the suction muffler 1 has a first damping chamber 5 with a floor 8, a second damping chamber 6 with a floor 9, and a third damping chamber 7 with a floor 10. The floors, 8, 9, 10 are made in one piece in this embodiment example. A wall element 11, which separates the two damping chambers 5 and 6 in the region of their floors 8, 9 for the refrigerant is disposed between the first damping chamber 5 and the second damping chamber 6. This means that the wall element 11 prevents refrigerant from being able to pass from the first damping chamber 5 into the second damping chamber 6 and vice versa in the region of the floors 8, 9.

Analogously, an additional wall element 12 is disposed between the second damping chamber 6 and the third damping chamber 7, and it separates the two damping chambers 6, 7 in the region of their floors 9, 10 for the refrigerant. I.e., the additional wall element 12 keeps refrigerant in the region of floors 9, 10 from being able to pass from the second damping chamber 6 into the third damping chamber 7 and vice versa.

Of course, this does not mean that no exchange of refrigerant can take place between the damping chambers 5, 6, 7. Such exchange does take place through openings and/or free channels specifically provided for this (not shown).

Oil 14 that gets into the suction muffler 1 basically collects on the floors 8, 9, 10 because of the force of gravity when the suction muffler 1 is in operating position. In refrigeration compressor 2 the oil 14 is basically needed for lubrication of a piston/cylinder unit that compresses the refrigerant. In the operation of the refrigerant compressor 2, it is in general hardly possible, or practically impossible, to block the entry of oil 14 into the suction muffler 1 entirely.

In order to enable crossover for the oil 14 between the damping chambers 5, 6, a siphon segment is disposed in floors 8, 9 in the region of the wall element 11 between the first damping chamber 5 and the second damping chamber 6. The siphon segment 16 is made as a depression in the floors 8, 9. In this way a siphon-like connection between the damping chambers 5, 6 is produced for the oil 14.

This means that the siphon segment 16 ensures that oil 14 can pass from the first damping chamber 5 to the second damping chamber 6 (and basically also the other way around). Here the oil 14 forms a gas-tight seal in siphon segment 16 and thus prevents in particular a transfer of gaseous refrigerant between the damping chambers 5, 6 through the siphon segment 16. This also prevents sound from passing through the siphon segment 16 between the damping chambers 5, 6.

Likewise, another siphon segment 17, which is also connected to the channel 13, is disposed in the floors 9, 10 between the second damping chamber 6 and the third damping chamber 7 in the region of the additional wall element 12. The additional siphon segment 17 is likewise made as a depression in the floors 9, 10. In this way a siphon-like connection is produced between the damping chambers 6, 7 for the oil 14.

This means that the additional siphon segment 17 ensures that oil 14 can pass from the second damping chamber 6 to the third damping chamber 7 (and basically also the other way around). In doing so, the oil 14 in the additional siphon segment 17 forms a gas-tight seal and thus prevents in particular a crossover of gaseous refrigerant between the damping chambers 6, 7 through the additional siphon segment 17. Likewise, this keeps sound from being able to pass between the damping chambers 6, 7 through the additional siphon segment 17.

Refrigerant can be efficiently prevented from being suctioned through the siphon segment 16 or the additional siphon segment 17 and causing a troublesome bubbling noise by the openings and/or free channels (not shown) that are specially intended for the exchange of refrigerant between the damping chambers 5, 6, 7.

Figure 3:
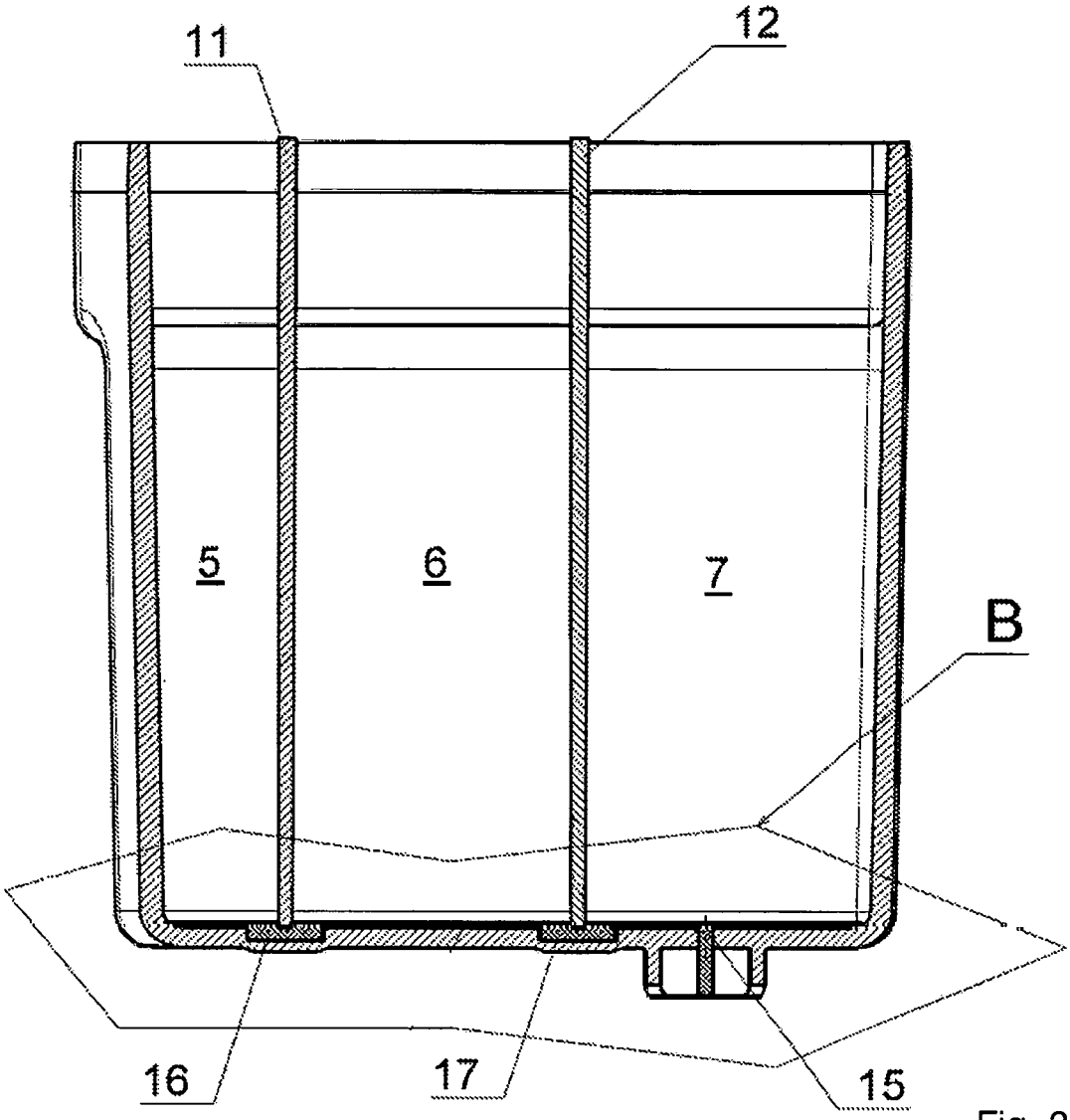
FIG. 3 shows a sectional view of the suction muffler in FIG. 1 through section line A-A in FIG. 2, where collected oil is shown

FIG. 3 illustrates the function of the siphon segments 16, 17 by means of a sectional view through section line A-A in FIG. 2, where the arrows in FIG. 2 indicate the direction of view. Because the siphon segment 16 and the additional siphon segment 17 are filled with oil 14, they are sealed gas-tight between the damping chambers 5, 6 on the one hand, and the damping chambers 6, 7 on the other—and thus essentially they are also sound-tight.

Figure 5:
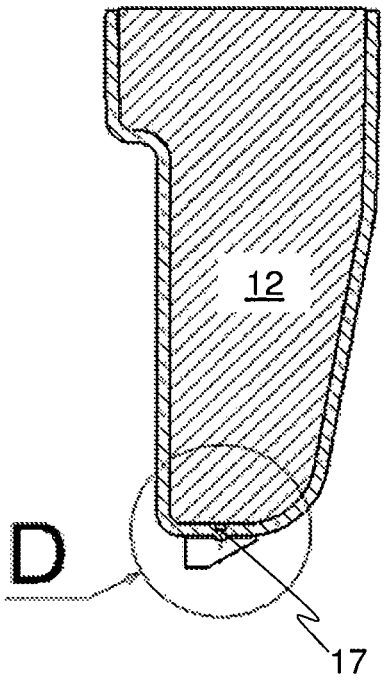
FIG. 5 shows a sectional view of the suction muffler in FIG. 1 through the section line C-C shown in FIG. 2, where collected oil is shown

The tight seal is illustrated by FIG. 5, which shows a segment through the additional wall element 12 through section line C-C in FIG. 2, where the arrows in FIG. 2 indicate the direction of view.

Figure 6:
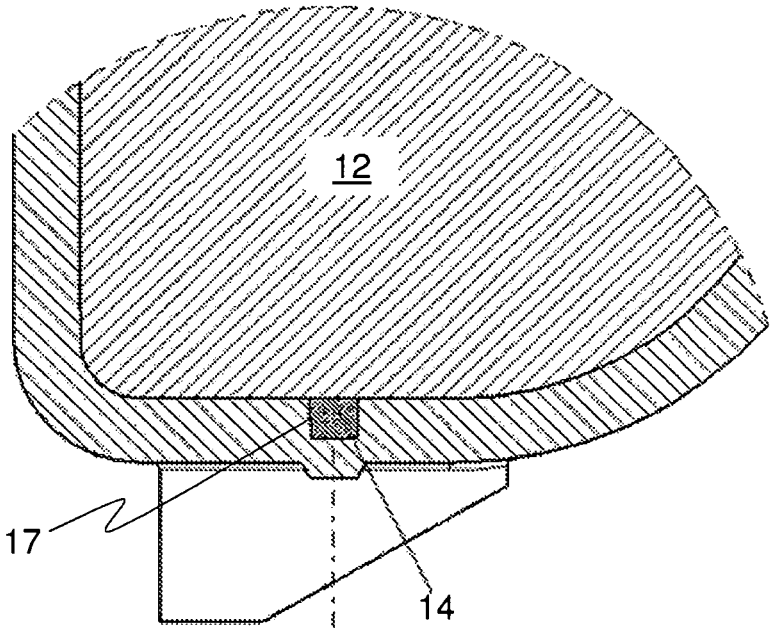
FIG. 6 shows an enlarged view of detail D in FIG. 5

Detail D in FIG. 5 is shown in enlarged view in FIG. 6. The additional siphon channel 17 is completely filled with oil 14. Together with the additional wall element 12, it thus separates the two damping chambers 6, 7 in the region of their floors 9, 10 completely for the gaseous refrigerant.

So that the oil 14 can flow out of the suction muffler 1, only one oil drain hole 15 is provided in floor 10 of the third damping chamber 7, so that all in all a maximum gas and sound tightness of the damping chambers 5, 6, 7 results. Said oil drain hole 15 can be seen particularly clearly in FIG. 4, which shows an enlarged view of detail B in FIG. 3. The floors 8, 9, 10 are covered with oil 14, so that an oil level $t_1$ results over the floor 10. In the additional siphon segment 17 that is designed as a depression, there is correspondingly a greater oil level $t_2$.

Figure 4:
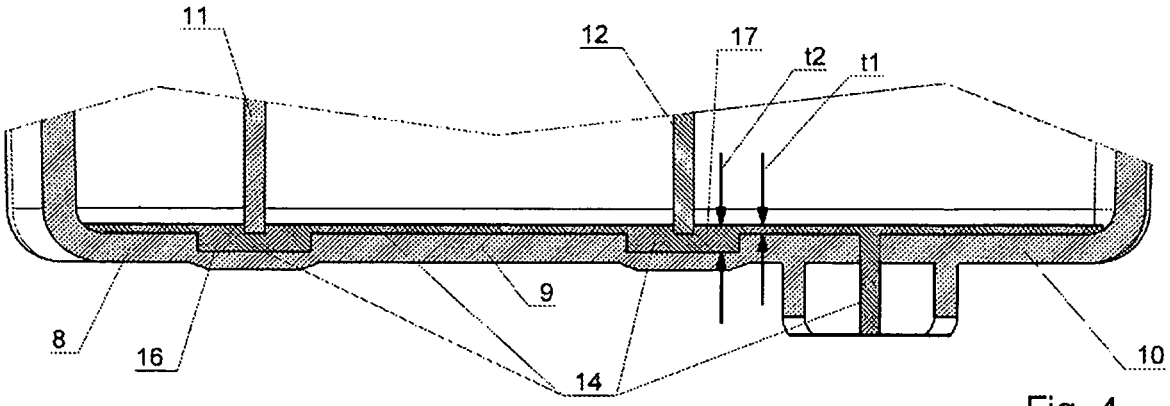
FIG. 4 shows an enlarged view of detail B in FIG. 3

Furthermore, one can see in FIG. 4 that the additional wall element 12 projects a little into the additional siphon segment 17. The additional siphon segment 17 together with the additional wall element 12 thus forms an essentially U- or V-shaped arrangement in cross section. An analogous statement applies to the siphon segment 16 together with the wall element 11 in the embodiment example shown in FIG. 4.

For a gas-tight seal of the additional siphon segment 17 it is thus sufficient if the oil 14 just fills the additional siphon segment 17 or if the oil level $t_2$ is just great enough that the additional wall element 12 just dips into the oil 14 or contacts the oil 14. This means that for the gas-tightness it is not necessary that the floors 9, 10 be also covered with oil 14 or that the oil level $t_1$ be greater than zero.

Because of the connection for the oil 14 between the damping chambers 5, 6, 7 that is realized by means of the siphon segments 16, 17, it is ensured that the oil 14 can ultimately flow from each damping chamber 5, 6, 7. Preferably, the siphon segments 16, 17 and the floors 8, 9, 10 are designed so that the oil 14 is directed to oil drain hole 15.

Figure 7:
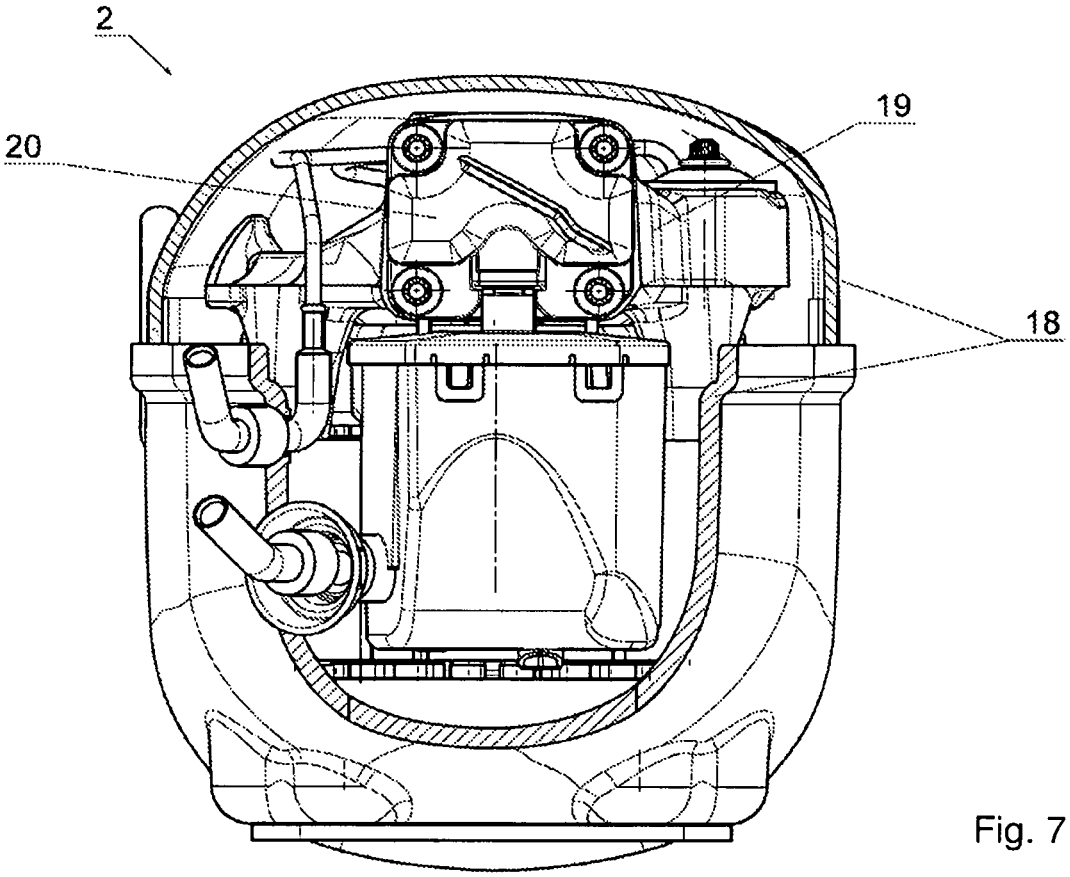
FIG. 7 shows a front view of a partially sectioned, hermetic refrigeration compressor with the suction muffler from FIG. 1

An example of the use of the suction muffler 1 in a refrigeration compressor 2 is shown in FIG. 7. The refrigeration compressor 2 has a hermetic compressor housing 18, in the interior of which a piston/cylinder unit 19 that compresses the refrigerant operates. The piston/cylinder unit 19 has a valve plate, in which a suction orifice is disposed, which in turn is a part of a suction valve, through which the refrigerant is suctioned. The valve plate or the suction valve is disposed at a cylinder head 20 of the piston/cylinder unit 19. Correspondingly, the suction muffler 1 is also disposed at cylinder head 20, where the outlet 4 connects to the suction valve, so that the refrigerant can flow through the suction muffler 1 to the suction valve.

Figure 8:
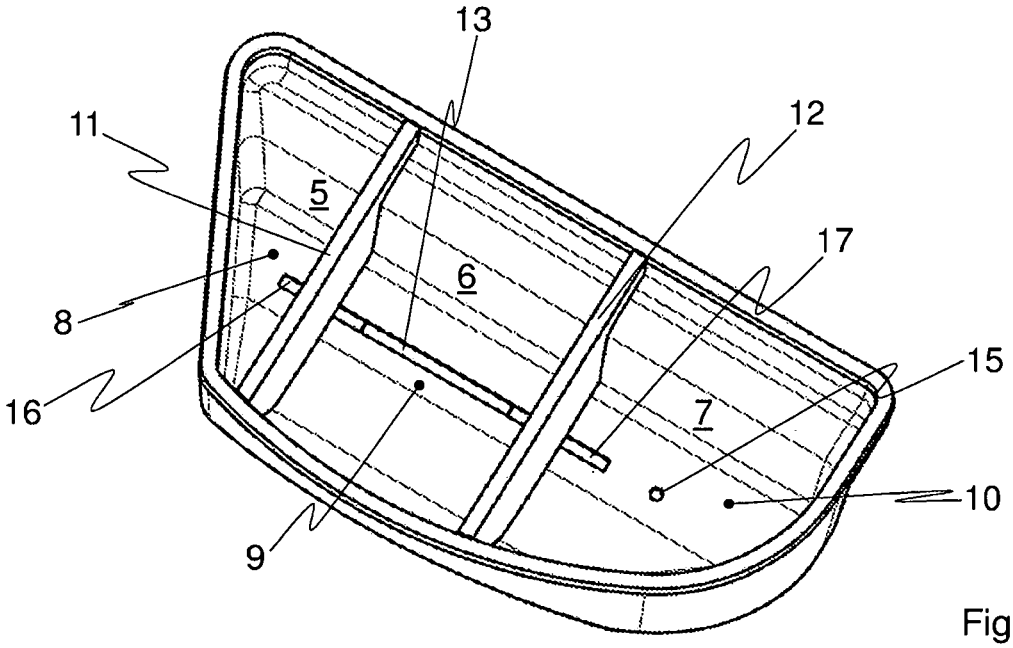
FIG. 8 shows an axonometric view of an alternative embodiment of the suction muffler according to the invention, with a channel

FIG. 8 shows another embodiment of the suction muffler 1 according to the invention, where another depression, which forms a channel 13 in which the oil 14 can collect, is disposed in the floors 8, 9, 10. In each case according to the design of the channel 13, oil 14 can be guided by means of channel 13 specifically to the siphon segments 16, 17 or specifically guided away from them. Preferably, therefore, the additional depression is made at least in a segment somewhat less deep than the depressions that form the siphon segments 16, 17.

The channel 13 can also be extended up to the oil drain hole 15 (not shown), so that in the indicated embodiment example it would then connect the additional siphon segment 17 to the oil drain hole 15. Through the appropriate layout of the channel 13, the oil 14 can be specifically directed to the oil drain hole 15 in this way.

Figure 9:
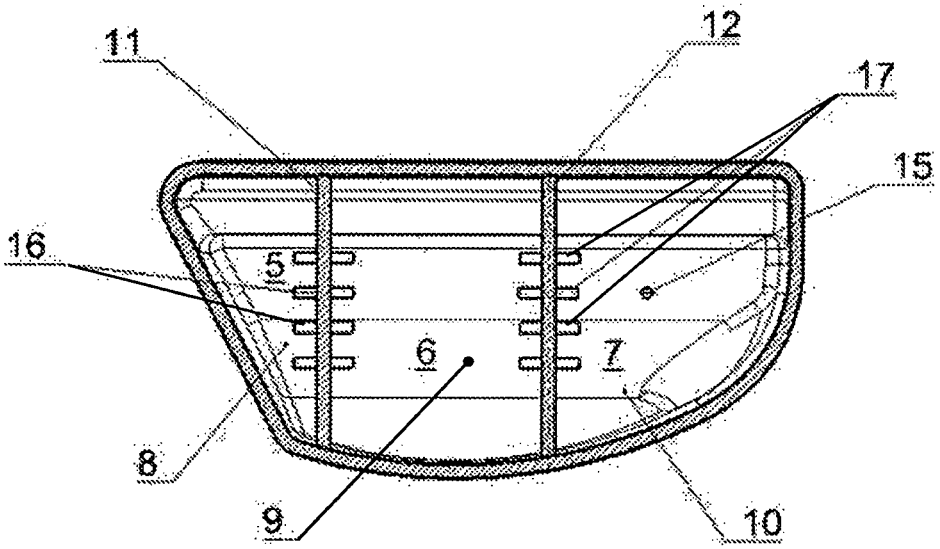
FIG. 9 shows a view that is analogous to FIG. 2 of an additional alternative embodiment of the suction muffler according to the invention, with a plurality of siphon segments

FIG. 9 shows another embodiment of the suction muffler 1 according to the invention with a plurality of siphon segments 16. This can be advantageous, in particular if there is a relatively large amount of oil 14 being collected. Then a trouble-free exchange of the oil 14 between the damping chambers 5 and 6 is ensured by the large number of siphon segments 16. Preferably in this case, as shown, a plurality of additional siphon segments 17 is also provided.

Figure 10:
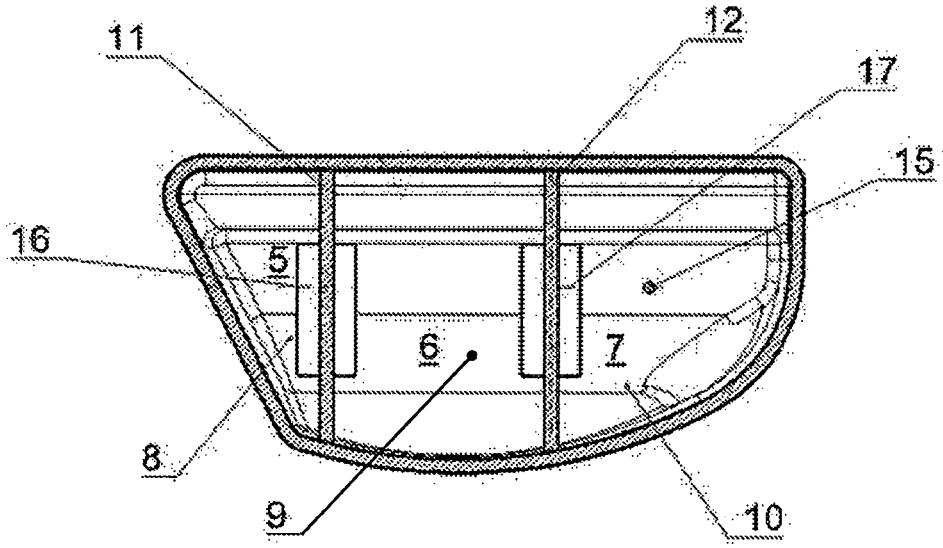
FIG. 10 shows a view that is analogous to FIG. 2, of an additional alternative embodiment of the suction muffler according to the invention, with a siphon segment essentially extending over an entire width of floors of damping chambers of the suction muffler

FIG. 10 shows another embodiment of the suction muffler 1 according to the invention, which likewise enables in particular the unhindered exchange of large amounts of oil 14 between the damping chambers 5 and 6. In this case the siphon segment 16 is made very wide and extends along the wall element looking through a large section of the floors 8, 9, or almost over an entire width of the floors 8, 9. Because of its width, the siphon segment 16 need not be designed to be especially deep in order to be able to accommodate sufficient oil 14. Preferably in this case, as shown, a very wide additional siphon segment 17 is also provided. The additional siphon segment 17 also extends over almost the entire width of the floors 9, 10 and, because of its width, need not be designed to be especially deep, in order to be able to accommodate sufficient oil 14.

In the embodiment example in FIG. 4, the siphon segments 16, 17 have an essentially rectangular cross section, which in combination with the wall elements 11, 12 results in an essentially U-shaped arrangement. Of course, a large number of other, rectangular and/or round, cross-sectional forms of the siphon segments 16, 17—and also the wall elements 11, 12, is possible in order in the end to achieve an essentially U- or V-shaped arrangement.

Figure 11:
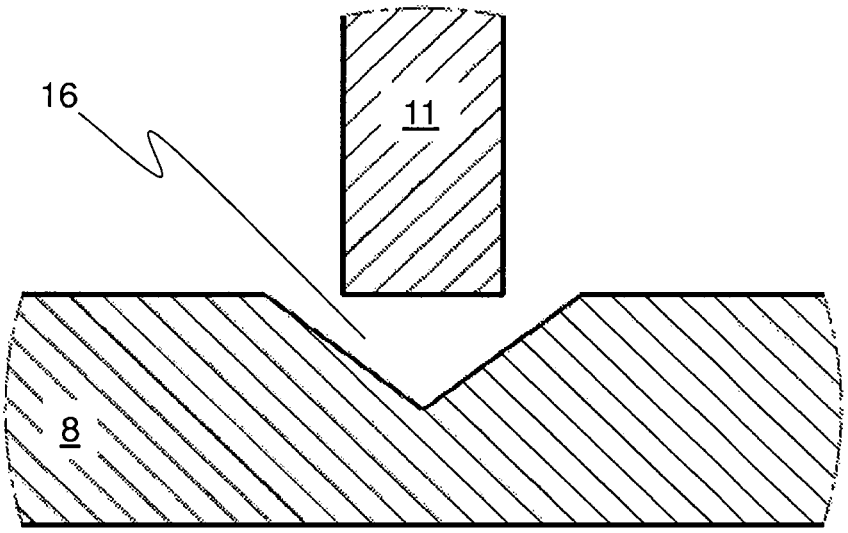
FIG. 11 shows a schematic sectional view, which is analogous to FIG. 4, with an enlarged representation of a siphon segment having an alternative cross-sectional form

For illustration FIG. 11 shows a siphon segment 16 with a triangular cross section, in an enlarged representation. Together with the wall element 11, which has a rectangular cross section, a V-shaped arrangement results.

Figure 12:
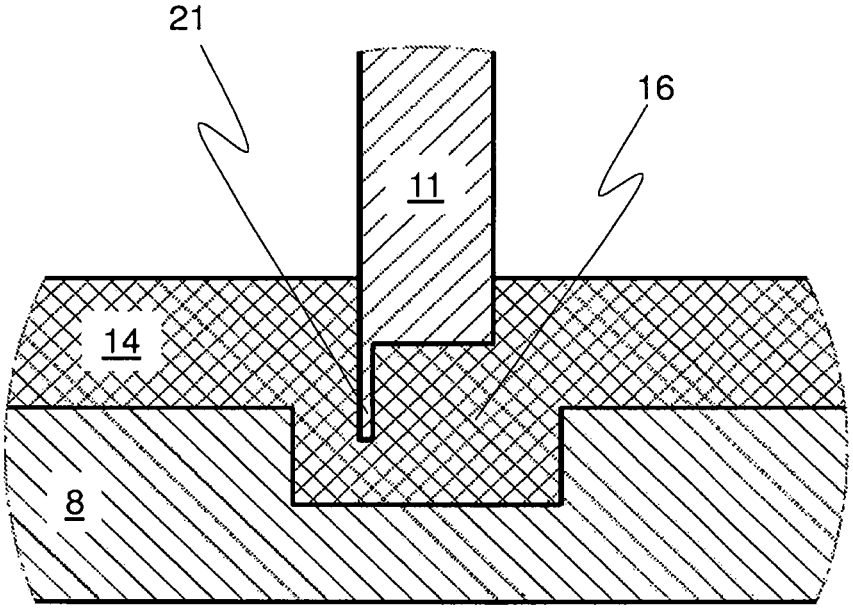
FIG. 12 shows a schematic sectional view, which is analogous to FIG. 4, having an enlarged representation of a siphon segment, where a sealing lip is provided.

FIG. 12 in turn shows a design variation in which the siphon segment 16 has a rectangular cross section, although the cross section of the wall element 11 deviates from a simple rectangular cross section. The wall element 11 has a sealing lip 21 that extends in the direction of the siphon segment 16 and that in the embodiment example shown in turn has a rectangular cross section. The sealing lip 21 is considerably thinner than the remaining wall element 11, and only the sealing lip 21 extends from the wall element 11 into the siphon segment 16. Here the sealing lip 21 projects so far into the siphon segment 16 so that gas and sound tightness is achieved even if there is a very low oil level $t_2$ in the siphon segment 16. Because only the sealing lip 21 projects into the siphon segment 16, it is possible to save on material and costs.

REFERENCE NUMBER LIST

1 Suction muffler
2 Refrigeration compressor
3 Inlet
4 Outlet
5 First damping chamber
6 Second damping chamber
7 Third damping chamber
8 Floor of first damping chamber
9 Floor of second damping chamber
10 Floor of third damping chamber
11 Wall element
12 Additional wall element
13 Channel
14 Oil
15 Oil drain hole
16 Siphon segment
17 Additional siphon segment
18 Compressor housing
19 Piston/cylinder unit
20 Cylinder head
21 Sealing lip
$t_1$ Oil level in damping chamber
$t_2$ Oil level in siphon segment

The invention claimed is:

1. A suction muffler for a hermetic refrigeration compressor, the suction muffler comprising an inlet, so that refrigerant can flow into the suction muffler, and an outlet, so that refrigerant can flow out from the suction muffler, the suction muffler further comprising two damping chambers for sound damping, where the two damping chambers each has a floor and where a wall element is provided in order to separate the two damping chambers from each other for the refrigerant in the region of their floors, wherein in the region of the wall element at least one siphon segment connecting the two floors is disposed, in order to receive oil in an operating position of the suction muffler, where the at least one siphon segment connects the two damping chambers to each other for the oil in siphon fashion.

2. The suction muffler as in claim 1, wherein in at least one of the two floors a channel is disposed, in order to accommodate oil in the operating position of the suction muffler, where the channel is connected to the at least one siphon segment.

3. The suction muffler as in claim 1, wherein the at least one siphon segment is made as a depression in the two floors.

4. The suction muffler as in claim 1, wherein at least one additional damping chamber is provided, in that the at least one additional damping chamber has a floor, in that at least one additional wall element is provided, in order to separate the at least one additional damping chamber for the refrigerant from at least one of the other damping chambers in the region of the relevant floor, where in the region of the at least one additional wall element at least one additional siphon segment connecting the relevant floors is disposed, in order to receive oil in an operating position of the suction muffler, and where the at least one additional siphon segment connects the at least one additional damping chamber for the oil to at least one of the other damping chambers in siphon fashion.

5. The suction muffler as in claim 4, wherein a channel is also disposed in the floor of the at least one additional damping chamber in order to receive oil in the operating position of the suction muffler, where the channel is connected to the at least one additional siphon segment.

6. The suction muffler as in claim 1, wherein an oil drain hole is disposed in the floor of a damping chamber.

7. The suction muffler as in claim 6, wherein one oil drain hole is provided.

8. The suction muffler as in claim 6, wherein a channel is connected to the oil drain hole.

9. The suction muffler as in claim 1, wherein the floors and the at least one siphon segment are made in one piece.

10. A hermetic refrigeration compressor, which has a hermetic compressor housing, in the inside of which a piston/cylinder unit that compresses the refrigerant operates with a suction valve comprising a suction opening disposed in a valve plate thereof, where a suction muffler as in claim 1 is disposed on a cylinder head of the piston/cylinder unit so that the refrigerant can flow through the suction muffler to the suction valve.

11. The suction muffler as in claim 2, wherein the channel is made as an additional depression in the at least one of the two floors, where the additional depression is, at least in a segment, less deep than the said depression.

12. The suction muffler of claim 4, wherein the floors and the at least one siphon segment and the at least one additional siphon segment are made from one piece.

* * * * *